United States Patent [19]

Schwander et al.

[11] 4,358,065

[45] Nov. 9, 1982

[54] APPARATUS FOR PRODUCING THREAD OR YARN RESERVE WINDINGS ON A BOBBIN TUBE

[75] Inventors: Andreas Schwander, Seuzach; Dieter Thalmann, Winterthur, both of Switzerland

[73] Assignee: Rieter Machine Works, Ltd., Winterthur, Switzerland

[21] Appl. No.: 177,754

[22] PCT Filed: Mar. 12, 1979

[86] PCT No.: PCT/EP79/00013

§ 371 Date: Nov. 9, 1979

§ 102(e) Date: Nov. 9, 1979

[87] PCT Pub. No.: WO79/00803

PCT Pub. Date: Oct. 18, 1979

[30] Foreign Application Priority Data

Mar. 21, 1978 [CH] Switzerland ..... 3048/78

[51] Int. Cl.[3] ..... B65H 54/02; B65H 54/34

[52] U.S. Cl. ..... 242/18 PW

[58] Field of Search ..... 242/18 PW

[56] References Cited

U.S. PATENT DOCUMENTS

| | | | |
|---|---|---|---|
| 2,481,031 | 9/1949 | McDermott | 242/18 PW |
| 3,488,010 | 1/1970 | Parry | 242/18 PW |
| 3,741,488 | 6/1973 | Wuest | 242/18 PW |
| 3,792,818 | 2/1974 | Bauer et al. | 242/18 PW |
| 3,955,768 | 5/1976 | Fluck | 242/18 PW |
| 3,964,690 | 6/1976 | Tauleigne | 242/18 PW |
| 3,971,518 | 7/1976 | Newman et al. | 242/18 PW |
| 3,999,716 | 12/1976 | Spaller, Jr. | 242/18 PW |
| 4,049,209 | 9/1977 | Bach et al. | 242/18 PW |
| 4,057,196 | 11/1977 | Amos | 242/18 PW |
| 4,105,165 | 8/1978 | Miyazaki et al. | 242/18 PW |
| 4,195,788 | 4/1980 | Miyazaki et al. | 242/18 PW |

FOREIGN PATENT DOCUMENTS

| | | | |
|---|---|---|---|
| 2332220 | 1/1975 | Fed. Rep. of Germany | 242/18 PW |
| 2247906 | 5/1975 | France | 242/18 PW |

*Primary Examiner*—Stanley N. Gilreath

*Attorney, Agent, or Firm*—Kenyon and Kenyon

[57] ABSTRACT

The invention concerns an apparatus for producing thread or yarn reserve windings on a rotating bobbin tube (2), with a lever (5) for transferring the thread to the thread catching zone at the face side of the bobbin tube, with a thread guide curve (17) for guiding the thread while the thread reserve windings are formed, and with a thread stop (15) for temporarily holding the thread on the thread guide curve (17) for producing the thread reserve windings.

6 Claims, 5 Drawing Figures

Figure 4:
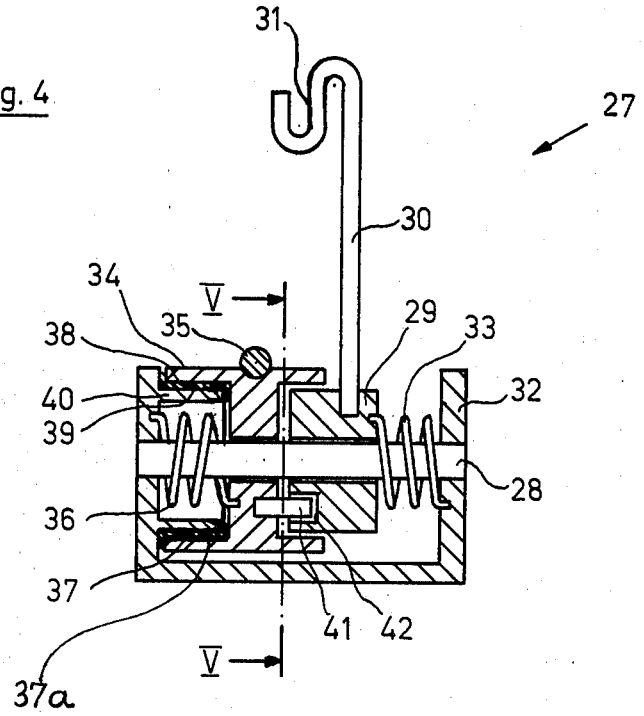

Fig. 1
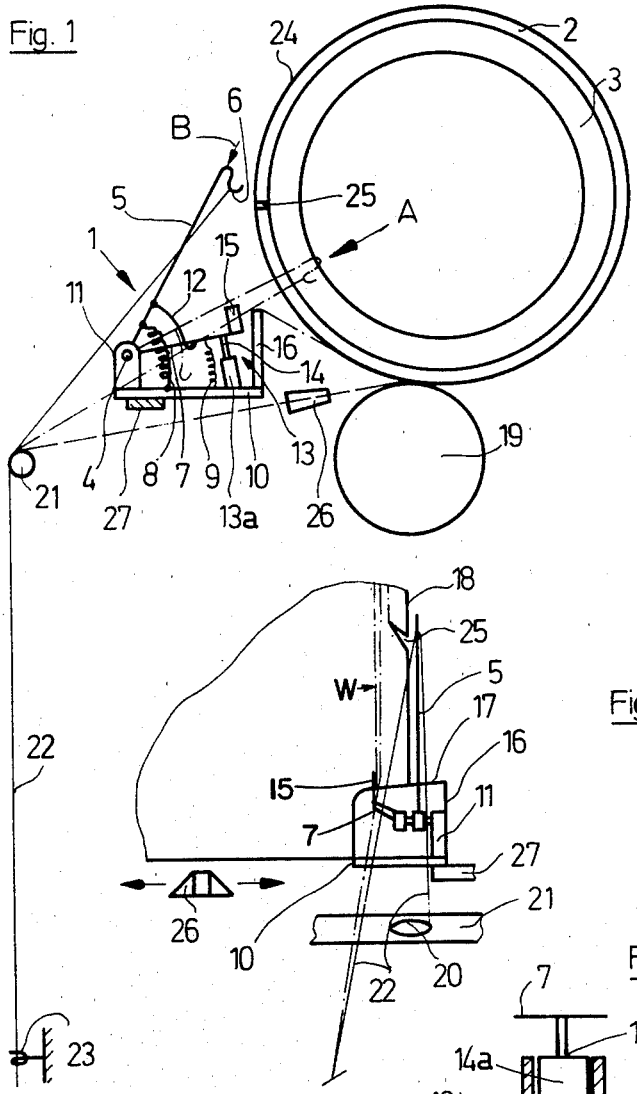
Fig.2
Fig.3
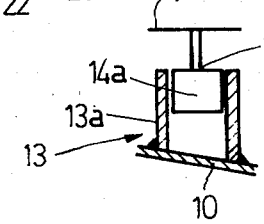

APPARATUS FOR PRODUCING THREAD OR YARN RESERVE WINDINGS ON A BOBBIN TUBE

Devices for producing thread or yarn reserve windings are commonly known in practical use, which are either relatively simple but depend on the thread tension, or which are relatively complex due to the elements to be controlled if they are independent of the thread tension.

In the German DOS No. 2,347,644 e.g. a device depending on the thread tension is described, in which the thread to be placed onto the bobbin tube is guided by a mobile suction gun to a thread stop, which is held back magnetically, and subsequently is guided into a thread catching zone at the face side of the tube for taking up the thread on the bobbin tube. After the thread is taken over by the rotating tube, a force increasingly acting onto the aforementioned thread stop is generated, which force pivots the stop out of the magnetic field. In this process the thread after initially forming thread reserve layers moves towards the center of the bobbin tube, i.e. into the zone of thread traversing motion.

Devices depending on the thread tension of such type show the disadvantage that the number of windings, or the distance between windings respectively, vary according to the thread tension which is adapted to the winding speed and to the thread material processed.

A device, which functions independently of the thread tension, but is relatively complicated, is described in German DAS No. 1,806,243. In this device, the thread reserve windings are formed by a lever arrangement activated stepwise by the traversing motion device.

It thus is the object of the present invention to create an apparatus, which functions independently of thread tension, and using which the thread in most simple operation and with simplest design can be transferred onto the rotating bobbin tube for producing thread reserve windings.

During use, the pivotally mounted lever is movable between a rest position and a set back position. When the lever is in the rest position, the thread guide is able to guide a thread into the thread catching zone of the bobbin 2. When moved from the rest position towards the set back position, the carrier element carries the pivotally mounted thread stop along with the lever. Upon release of the lever, the force means pivots the lever towards the rest position while the force means for the thread stop pivots the thread stop in the same direction. However, the damping element dampens the pivoting of the thread stop in this direction.

The thread guide is positioned to receive the thread thereon during pivoting of the lever towards the rest position and thereafter guides the thread towards the longitudinal center of the bobbin tube after catching of the thread in the catching zone of the bobbin tube.

Briefly, the invention provides an apparatus for producing thread reserve windings on a bobbin tube placed on a rotating bobbin chuck. This apparatus comprises a pivotally mounted lever having a thread guide for guiding a thread into a thread catching zone of the bobbin tube and a pivotally mounted thread stop offset from the thread guide towards a longitudinal center of the bobbin tube. In addition, a carrier element is provided for carrying the thread stop with the lever during pivoting of the lever. Separate force means are also provided for pivoting lever and the thread stop in the same direction while a damping element is provided for dampening the pivoting of the thread stop in this latter direction. Still further, a thread guide curve is positioned in a plane parallel to the bobbin tube and is downwardly curved in a direction towards the longitudinal center of the bobbin tube for guiding a thread thereon.

In one embodiment, the thread stop is mounted on a second lever which is supported concentrically with the first lever. In this case, the carrier member is mounted on the first lever and is disposed under the second lever so as to carry the second lever with the first lever.

In another embodiment, the thread stop is mounted on a sleeve which is supported coaxially with the lever. In this embodiment, the carrier member is in the form of a pin mounted on the sleeve.

In order to obtain a sufficient dampening effect, the dampening element comprises a first fixed part and a second part which is connected with the thread stop and which is moveable therewith. These parts are coupled frictionally via a highly viscous liquid. In this case, the damping element may be in the form of a dashpot or a rotary element.

Figure 5:
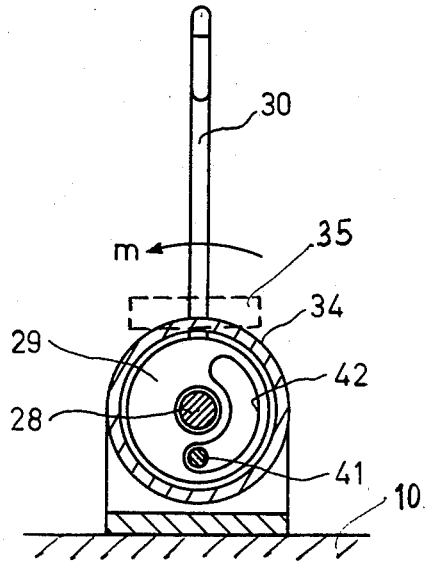

These and other objects and advantages of the invention will become more apparent from the following detailed description taken in conjunction with the accompanying drawings wherein:

FIG. 1 a schematic view of an apparatus for producing thread reserve windings, seen in axial direction of the bobbin tube, FIG. 2 a schematic, partial side view of the apparatus according to FIG. 1, FIG. 3 a simplified section of a detail of the apparatus, FIG. 4 an alternative design example of the apparatus shown partially in a secion parallel to the bobbin axis, FIG. 5 the apparatus according to FIG. 4 shown in a section along the line V—V of FIG. 4.

An apparatus 1 for producing thread reserve windings on a bobbin tube 2 placed on a rotating bobbin chuck 3 comprises a lever 5 pivotable about an axis 4, with a thread guide 6, and a lever 7, also pivotable about the axis 4, arranged, as seen in longitudinal direction towards the bobbin centre, behind the lever 5. The lever 5 as well as the lever 7 each are connected via a tension spring 8, and 9 respectively, with a base plate 10. The base plate 10 in turn is rigidly connected with a machine frame 27 (indicated merely) of a winding device. The axis 4 is defined by a member rigidly mounted in a support member 11 mounted onto the base plate 10.

The lever 5 furthermore is provided with a carrier member 12 extending to below the lever 7.

A damping element 13 is provided between the lever 7 and the base plate 10. This damping element 13 is in the form of a dashpot and consists of a cylinder **13*a* connected to the base plate 10 and of a piston 14 connected with the lever 7. As shown in FIG. 3, a highly viscous liquid or oil (e.g. of a viscosity of $10^6$ Centistokes) is provided between a part 14*a* of the piston 14 located in the cylinder 13*a* and the inside wall of the cylinder 13*a* in order to dampen the movement of the piston 14**.

The clearance between the piston part **14*a* and the inside wall of the cylinder 13*a* is chosen such that the movement between the piston 14 and the cylinder 13*a*** is not prevented.

Instead of using a piston and cylinder arrangement, use may be made of the cylinder **13*a* and the piston 14*a*, also a combination not shown can be provided, consisting of a plate (not shown) connected to the base plate 10, and of a plate (not shown) connected with the lever 7. A highly viscous oil provided between the two plates dampens the movement of lever 7**. The distance between the plates is chosen such that the oil substantially can not leak from between the plates and, on the other hand, such that the relative movement of the plates is possible.

At the end of lever 7 furthermore a thread stop 15 is provided.

On the end of the base plate 10 extending towads the bobbin tube 2, a plate 16 with a thread guide curve 17 is arranged. The curve 17 extends, as seen from a face side 18 of the tube 2 in the direction of the bobbin tube center, downward, i.e. extends inclined towads the base plate 10.

The bobbin tube is driven by a friction drive drum 19. If, after a new empty tube 2 is donned, the thread 22 being sucked off into an opening 20 of a suction tube 21, arranged below the lever 5, as shown in FIG. 2, is to be transferred onto the bobbin tube 2 again for the subsequent next winding process, the thread 22 is taken by hand, the lever 5 is manually set back from a rest position A (FIG. 1) against the tension force of the spring 8 into the set back position B, and the thread 22, as indicated in FIGS. 1 and 2 with a solid line, is placed into the thread guide 6. Subsequently the lever 5 is released, in such manner as to move back to the rest position A under the influence of the spring 8. In this position, the thread 22 is deflected on the face side tube edge 24, as the thread 22 is guided in the thread guide 23 provided for forming the thread traversing triangle known as such, until being caught by a thread catching slot 25 (FIG. 2) located on the face side 18 of the tube 2 and is wound onto the bobbin tube end.

While the lever 5 is set back, as described above, the lever 7 also is lifted, activated by the carrier member 12, from an initial position (not indicated) into a position shown in FIG. 1, the force of the spring 9 being overcome in this process, in which position the thread stop 15 extends over the thread guide curve 17.

During the above mentioned winding process the thread, which tends towards the center of the bobbin tube 2 owing to the thread tension, is guided along the thread guide curve 17 (shown in FIG. 1) to the thread stop 15. At this time, the thread 22 produces, owing to this thread stop 15, thread reserve windings w until the spring 9 has pulled down the lever 7, delayed by the influence of the dampening element 13, towards the aforementioned initial position of the lever 7 to the extent that the thread 22 is no longer held back by the thread stop 15 but continues to move along the thread guide curve 17 into the reach of a traversing thread guide 26 into the position indicated in FIG. 1 with broken lines. The normal bobbin package winding process then starts.

Instead of the lever 7 and of the spring 9, a flat spring (not shown) provided with the thread stop 15 can be applied, which is mounted onto the axis 4 and is pivotable in the sense of being bendable.

Instead of the tension springs acting onto the levers, pressure springs can also be applied.

Referring to FIGS. 4 and 5 wherein only the elements in the arrangement differing from the corresponding elements described with reference to FIGS. 1 through 3 are illustrated an alternative apparatus may be used for producing thread or yarn reserve windings on a bobbin tube.

This apparatus comprises a lever 30, which is arranged to pivot about an axis defined by a pivot pin 28 on a hub 29, with a thread guide device 31. The pin 28 is rigidly supported on both sides in a support 32. A force means 33 in the form of e.g. a torsion spring, ensures that the lever 30 can be pivoted from an idling position illustrated in FIGS. 4 and 5 counterclockwise (according to the arrow m of FIG. 5) only if a torsion momentum is overcome.

A sleeve or rotary element 34 is also rotatably supported on the pivot pin 28 and carries a thread stop 35 in the form of a small round rod (indicated in a cross-section in FIG. 4 and indicated with dash-dotted lines in FIG. 5) on the surface.

A force means 36, provided also here in the form of a torsion spring, ensures that the sleeve 34 with the thread stop 35 can be rotated in the same direction as the lever 30 only if a momentum is overcome. Whereas the lever 30, or the hub 29, under the influence of the spring 33 can be pivoted back freely (not considering the neglegible friction between the hub 29 and the pin 28), the sleeve 34 can be rotated back under the dampening influence of the spring 36, as the thread stop 35 (or the sleeve 34 supporting it, respectively), which is rotatable about the pin 28, is provided with a dampening element 37. The dampening element 37 consists of a highly viscous oil, which fills or annular gap **37*a* between the inner cylindrical surface 38 of the sleeve 34 and the outer cylindrical surface 39 of a collar 40, which is rigidly connected with the support 32 and extends into the sleeve 34. The annular gap 37*a*, if required, is sealed by suitable seals (not shown). The sleeve 34 thus can be rotated on the pin 28** only if predetermined friction forces exerting a dampening action are overcome.

A carrier member in the form of a pin 41 is rigidly anchored in the sleeve 34. This carrier member 41 has a free end which extends into a kidney-shaped groove 42 provided in the hub 29. In the idling position of the apparatus illustrated in FIG. 5 the groove 42 is laid out such that the pin 41 is located with one end in the groove 42.

If now for the formation of the thread reserve the lever 30 is pivoted manually counterclockwise (arrow m, FIG. 5), which corresponds to the pivoting of the lever 5 from the position A into the position B as described with reference to FIGS. 1 through 3, also the sleeve 34, and thus the thread stop 35, are carried on, or rotated, respectively, counterclockwise by the pin 41.

The thread stop 35 thus is brought into the position shown in FIG. 1 for the thread stop 15, in which position the stop 35 protrudes over the thread guide curve (not shown, but corresponds exactly to the thread guide curve 17 shown in FIG. 1) and thus retains the thread for the formation of the thread reserve windings.

If the lever 30 now is released, the lever 30 jumps back to its initial position immediately (clockwise) under the influence of the spring 33, whereas the sleeve 34 rotates back slowly, against the friction forces of the dampening element 37, which must be overcome, under the influence of the spring 36. The pin 41 in this process slowly moves freely in the groove 42.

The operational function of the apparatus according to FIGS. 4 and 5 entirely corresponds to the one of the apparatus described with reference to FIGS. 1 through 3 and thus does not require repeated description of its function. Instead of the dampening element 37 (i.e. the oil layer or film) of course any other element dampening the rotational movement of the sleeve 34 can be applied

We claim:

1. An apparatus for producing thread reserve windings on a bobbin tube placed on a rotating bobbin chuck, said apparatus comprising a pivotally mounted lever movable between a rest position and a set back position and having a thread guide for guiding a thread into a thread catching zone of the bobbin tube when in said rest position;

a pivotally mounted thread stop offset from said thread guide towards a longitudinal center of the bobbin tube;

a carrier element for carrying said thread stop with said lever during pivoting of said lever in a first direction away from said rest position towards said set back position;

a first force means for pivoting said lever in a second direction opposite said first direction;

a second force means for pivoting said thread stop in said second direction;

a damping element for dampening pivoting of said thread stop in said second direction; and a thread guide curve in a plane parallel to the bobbin tube for receiving a thread thereon during pivoting of said lever in said second direction, said thread guide curve being downwardly curved in a direction towards the longitudinal center of the bobbin tube for guiding a thread thereon after catching in said catching zone.

2. An apparatus as set forth in claim 1 wherein said thread stop is mounted on a second lever supported concentrically with said first lever, said carrier member being disposed under said second lever.

3. An apparatus as set forth in claim 1 wherein said thread stop is mounted on a sleeve supported coaxially with said lever and said carrier member is a pin mounted on said sleeve.

4. An apparatus as set forth in clwaim 1 wherein said damping element comprises a first fixed part and a second part connected with said thread stop and moveable therewith, said first and second parts being coupled frictionally via a highly viscous liquid.

5. An apparatus as set forth in claim 4 wherein said damping element is a dashpot.

6. An apparatus as set forth in claim 4 wherein said damping element is a rotary element.

* * * * *

UNITED STATES PATENT AND TRADEMARK OFFICE

CERTIFICATE OF CORRECTION

PATENT NO. : 4,358,065

DATED : November 9, 1982

INVENTOR(S) : Andreas Schwander, et al.

It is certified that error appears in the above—identified patent and that said Letters Patent is hereby corrected as shown below:

Col. 3, line 17, after "tube" insert --2--.

Col. 4, line 27, change "or" to --an--.

Col. 6, line 16, change "clwaim" to --claim--.

Signed and Sealed this

First Day of March 1983

[SEAL]

*Attest:*

GERALD J. MOSSINGHOFF

*Attesting Officer*

*Commissioner of Patents and Trademarks*